US009790002B2

(12) United States Patent
Tseng et al.

(10) Patent No.: US 9,790,002 B2
(45) Date of Patent: Oct. 17, 2017

(54) BAG WITH GRIPPING PANELS

(71) Applicant: Inteplast Group, Ltd., Livingston, NJ (US)

(72) Inventors: Ben Tseng, East Brunswick, NJ (US); Jyh-yao Raphael Li, Parsippany, NJ (US); Kelvin Yang, Madison, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 15/011,187

(22) Filed: Jan. 29, 2016

(65) Prior Publication Data

US 2016/0221723 A1 Aug. 4, 2016

Related U.S. Application Data

(60) Provisional application No. 62/109,287, filed on Jan. 29, 2015.

(51) Int. Cl.
*B65D 33/00* (2006.01)
*B65D 33/25* (2006.01)

(52) U.S. Cl.
CPC ..... *B65D 33/007* (2013.01); *B65D 33/2533* (2013.01); *B65D 33/2541* (2013.01); *B65D 33/2566* (2013.01); *B65D 2215/04* (2013.01)

(58) Field of Classification Search
CPC ..... A44B 19/16; B65D 33/2541; B65D 33/2591; B65D 33/007; B65D 33/2533; B65D 33/2566; B65D 2215/04; Y10T 24/45168; Y10T 24/50
USPC ..... 383/35, 210
See application file for complete search history.

(56) References Cited

U.S. PATENT DOCUMENTS 2,780,261 A * 2/1957 Svec ..... A45C 13/1023 383/65
2,823,720 A * 2/1958 Svec ..... A24F 23/02 24/585.12
3,991,801 A * 11/1976 Ausnit ..... A45C 3/00 24/585.12
4,637,061 A * 1/1987 Riese ..... B65D 31/12 206/219
4,682,366 A * 7/1987 Ausnit ..... B29C 66/474 156/66
4,758,099 A * 7/1988 Branson ..... B65D 33/16 383/35
4,842,421 A 6/1989 Bullard et al.
D373,951 S 9/1996 Heinhold et al.
5,839,831 A * 11/1998 Mazzocchi ..... B65D 33/2541 24/585.12
5,931,582 A * 8/1999 Nichols ..... B65D 33/2541 24/DIG. 50

(Continued)

*Primary Examiner* — Peter Helvey
(74) *Attorney, Agent, or Firm* — Senniger Powers LLP

(57) ABSTRACT

A bag has top and bottom edge margins and opposite side margins. First and second bag panels of the bag define a bag interior and an opening at the top edge margin of the bag. A reclosable closing structure at the top edge margin of the bag can repeatedly close the bag. First and second gripping panels are joined to the top edge margin of the bag at first and second joints, respectively. The gripping panels can provide surfaces for gripping when opening the bag, and the joints can be flexible to allow pivoting of the gripping panels relative to the bag. The gripping panels can be formed integrally with a closure for appending to a bag body.

20 Claims, 9 Drawing Sheets

(56) References Cited

U.S. PATENT DOCUMENTS 6,186,663 B1 2/2001 Ausnit
6,254,273 B1 * 7/2001 Galomb ..... B65D 33/16 383/120
6,296,388 B1 * 10/2001 Galomb ..... B65D 33/16 222/478
6,464,394 B1 * 10/2002 Galomb ..... B65D 31/10 24/30.5 R
6,488,410 B2 12/2002 Schneider
6,505,383 B2 * 1/2003 Machacek ..... B65D 33/2591 24/30.5 P
6,854,886 B2 2/2005 Piechocki et al.
6,939,040 B2 * 9/2005 Schneider ..... B31B 19/90 383/204
7,097,359 B2 8/2006 Plourde et al.
7,300,207 B2 * 11/2007 Linneweil ..... B65D 31/10 383/120
7,322,747 B2 1/2008 Borchardt
7,422,105 B2 * 9/2008 Loyd ..... A61F 13/55185 206/438
D584,144 S 1/2009 Mallory
7,506,487 B2 3/2009 Eads et al.
8,061,898 B2 11/2011 Pawloski et al.
D661,836 S 6/2012 Montarras
8,201,689 B2 * 6/2012 Kaern ..... A61M 25/002 206/364
8,215,839 B2 7/2012 Borchardt et al.
8,529,129 B2 9/2013 Turvey
D723,386 S 3/2015 Start et al.
D723,939 S 3/2015 Porchia et al.
D724,442 S 3/2015 Burggren et al.
D724,955 S 3/2015 Porchia et al.
9,011,003 B2 * 4/2015 Pawloski ..... B65D 33/2508 383/61.2
D736,099 S 8/2015 Deuerer
9,132,600 B2 * 9/2015 Leighton ..... B31B 19/18
2005/0281489 A1 12/2005 Yeh et al.
2006/0072857 A1 * 4/2006 Revels ..... A45C 3/10 383/35
2010/0209020 A1 8/2010 Delasalle
2011/0075951 A1 3/2011 Tseng

* cited by examiner

BAG WITH GRIPPING PANELS

CROSS REFERENCE TO RELATED APPLICATIONS

This application claims priority to U.S. Provisional Patent Application Ser. No. 62/109,287, which was filed on Jan. 29, 2015.

FIELD OF THE INVENTION

The present invention generally relates to plastic bags and more specifically to a plastic bag with gripping panels for opening the bag.

BACKGROUND OF THE INVENTION

Plastic bags are used for many different applications, such as shipping, food packaging, biohazard disposal, etc. Certain plastic bags are reclosable. Reclosable bags include a reclosable closing structure that can be used to selectively open and close the bag. It is desirable for the bag to have features for gripping when opening the reclosable closing structure.

SUMMARY

In one aspect, a bag has top and bottom edge margins and opposite side margins. The bag comprises first and second bag panels defining a bag interior and an opening at the top edge margin of the bag. A reclosable closing structure at the top edge margin of the bag is configured to repeatedly close the bag. First and second gripping panels are joined to the top edge margin of the bag at first and second joints, respectively. The first joint connects the first gripping panel to the first bag panel, and the second joint connects the second gripping panel to the second bag panel. The first and second gripping panels extend from the first and second joints, respectively, outwardly away from one another to define surfaces for gripping and pulling the first and second gripping panels apart to open the bag.

In another aspect, a bag has top and bottom edge margins and opposite side margins. The bag comprises first and second bag panels that define a bag interior and an opening at the top edge margin of the bag. A reclosable closing structure at the top edge margin of the bag is configured to repeatedly close the bag. First and second gripping panels are joined to the top edge margin of the bag at first and second flexible joints, respectively. The first joint connects the first gripping panel to the first bag panel and is configured to allow the first gripping panel to be pivoted about the first joint with respect to the first bag panel. The second joint connects the second gripping panel to the second bag panel and is configured to allow the second gripping panel to be pivoted about the second joint with respect to the second bag panel.

In another aspect, a reclosable closure is for repeatably closing a bag. The closure comprises first and second closure elements. Each of the first and second closure elements includes vertically oriented walls, an interlocking profile, and a gripping panel. Each interlocking profile extends inward from the respective wall in opposing relationship with the other interlocking profile, and the interlocking profiles are configured for interlocking engagement when the bag is closed. Each gripping panel is joined to the respective wall at a joint and extends outward from the respective joint to a free end spaced apart from the respective wall.

Other aspects, objects, and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Referring generally to the drawings, and particularly to FIGS. 1-5, one embodiment of a bag is generally indicated at reference number 10. As will be evident, the bag 10 includes features that make the bag easy to open. For example, upper margins of the bag 10 are laterally spaced apart from one another to readily provide a surface for gripping when opening the bag. The upper margins of the bag 10 can pivot with respect to the bag so that opening forces can be applied to the bag in range of directions.

Figure 1:
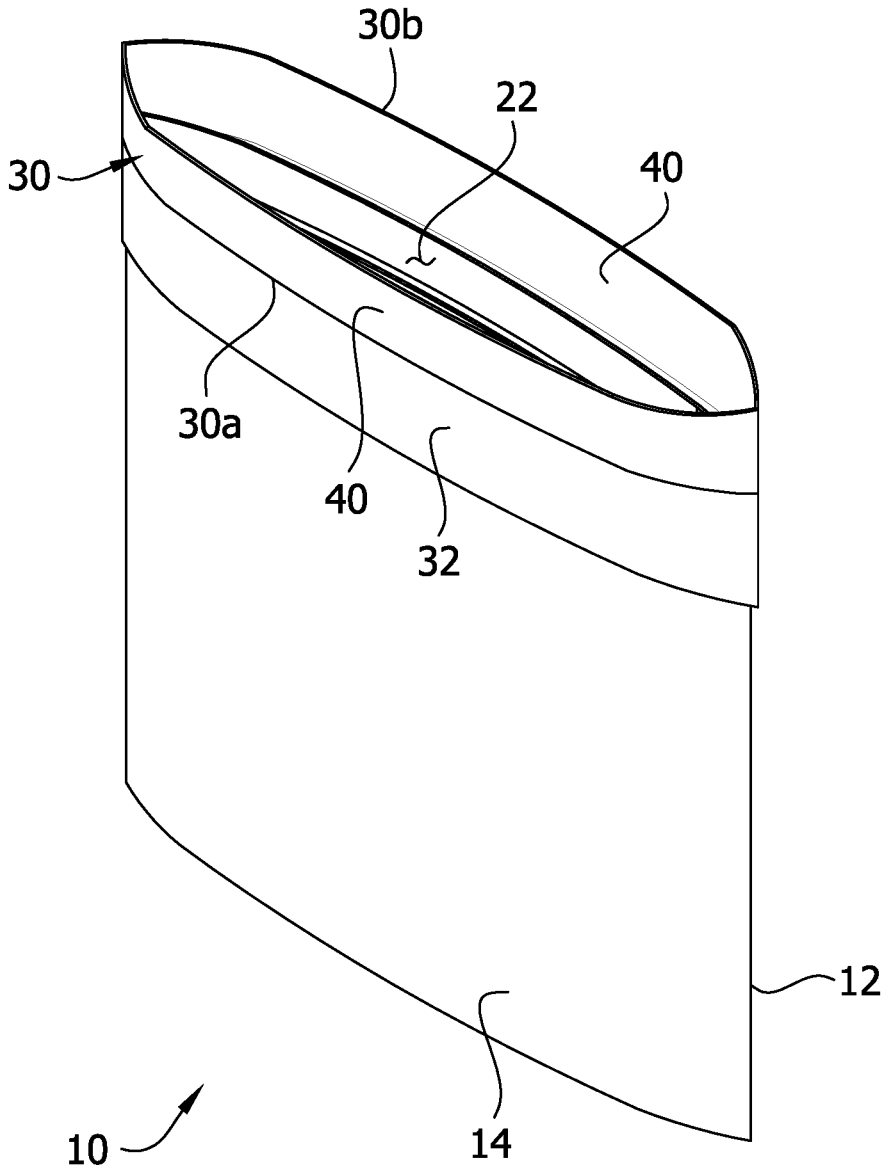
FIG. 1 is a perspective of an open bag.
Figure 2:
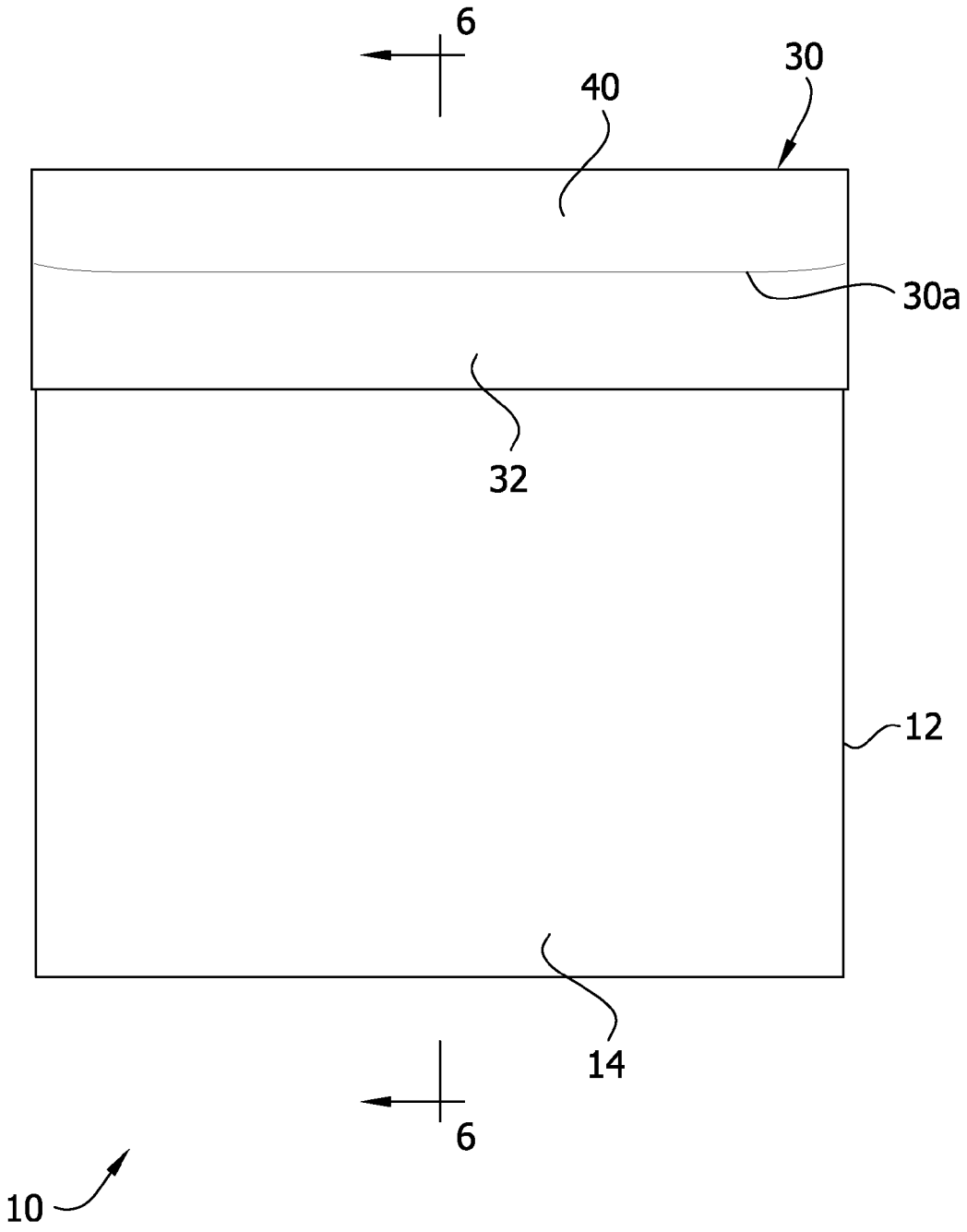
FIG. 2 is a front elevation of the bag.
Figure 3:
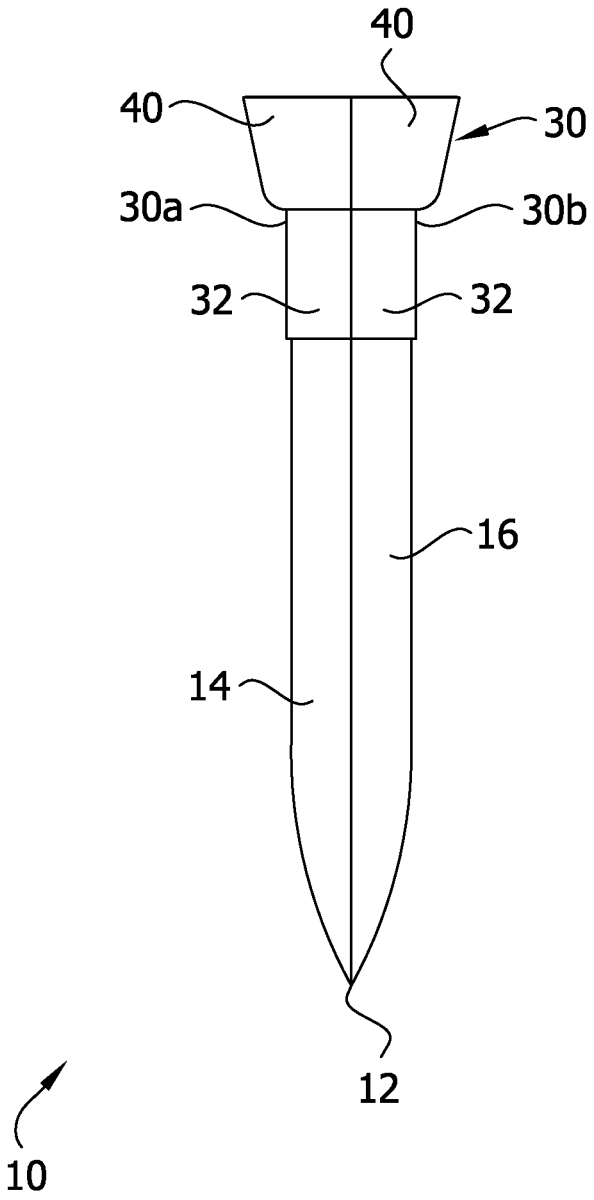
FIG. 3 is a side elevation of the bag.
Figure 4:
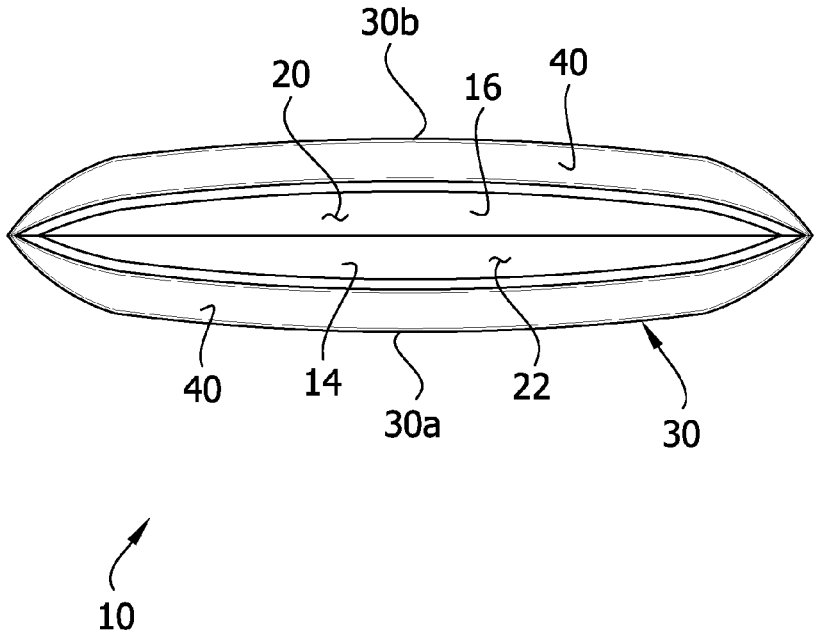
FIG. 4 is a top plan view of the bag.
Figure 5:
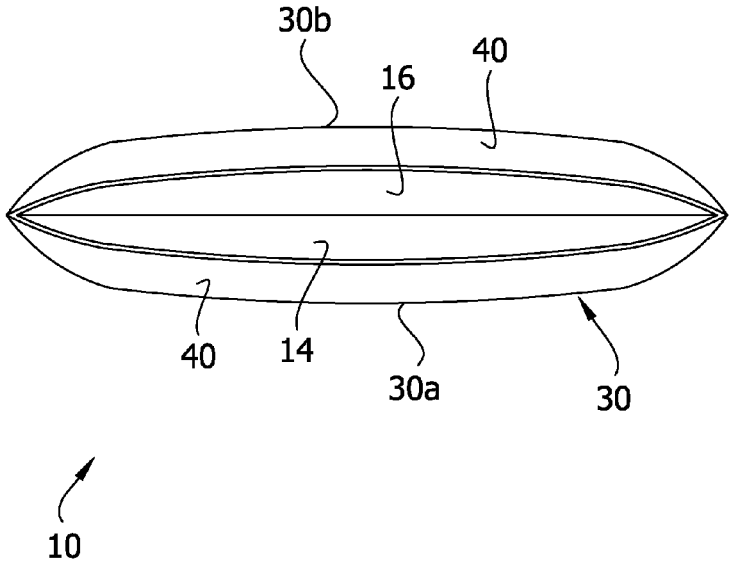
FIG. 5 is a bottom plan view of the bag.

The bag 10 includes a bag body 12 comprising front and rear panels 14, 16. As illustrated in the drawings, each of the panels has a top margin, bottom margin, and opposite side margins adjacent a top edge, bottom edge, and side edges, respectively (each of the margins is broadly an end margin). The panels 14, 16 are joined along their bottom margins and side margins to define a bag interior 20 (FIG. 4). In one embodiment, the panels 14, 16 are formed as a single sheet of material that is folded at the bottom of the bag body 12 along a linear fold, and the side margins are joined together along fusion lines. The panels can be joined together in other ways without departing from the scope of the invention. For example, the panels can be formed as separate sheets and fused together along the bottom margin and side margins. Whether the panels 14, 16 are formed as one piece and folded over, or formed as two pieces, the end margins are considered to be joined together for purposes of this description. In some embodiments, the end margins are joined to form a fluid tight, liquid tight, and/or gas tight seal. In other embodiments, the end margins can be joined together without forming a seal.

The bag interior 20 is adapted to receive items placed within the bag 10. The top margins of the bag panels 14, 16 can be initially unsecured along their length to define an opening 22 permitting access to the bag interior 20 and its contents. It will be understood that, though the top of the bag 10 defines the opening 22 in the illustrated embodiment, in other embodiments, the sides or bottom of the bag can define the opening without departing from the scope of the invention. Preferably, corresponding end margins of joined panels can define an opening that can be opened and closed in accordance with the principles set forth below.

Figure 6:
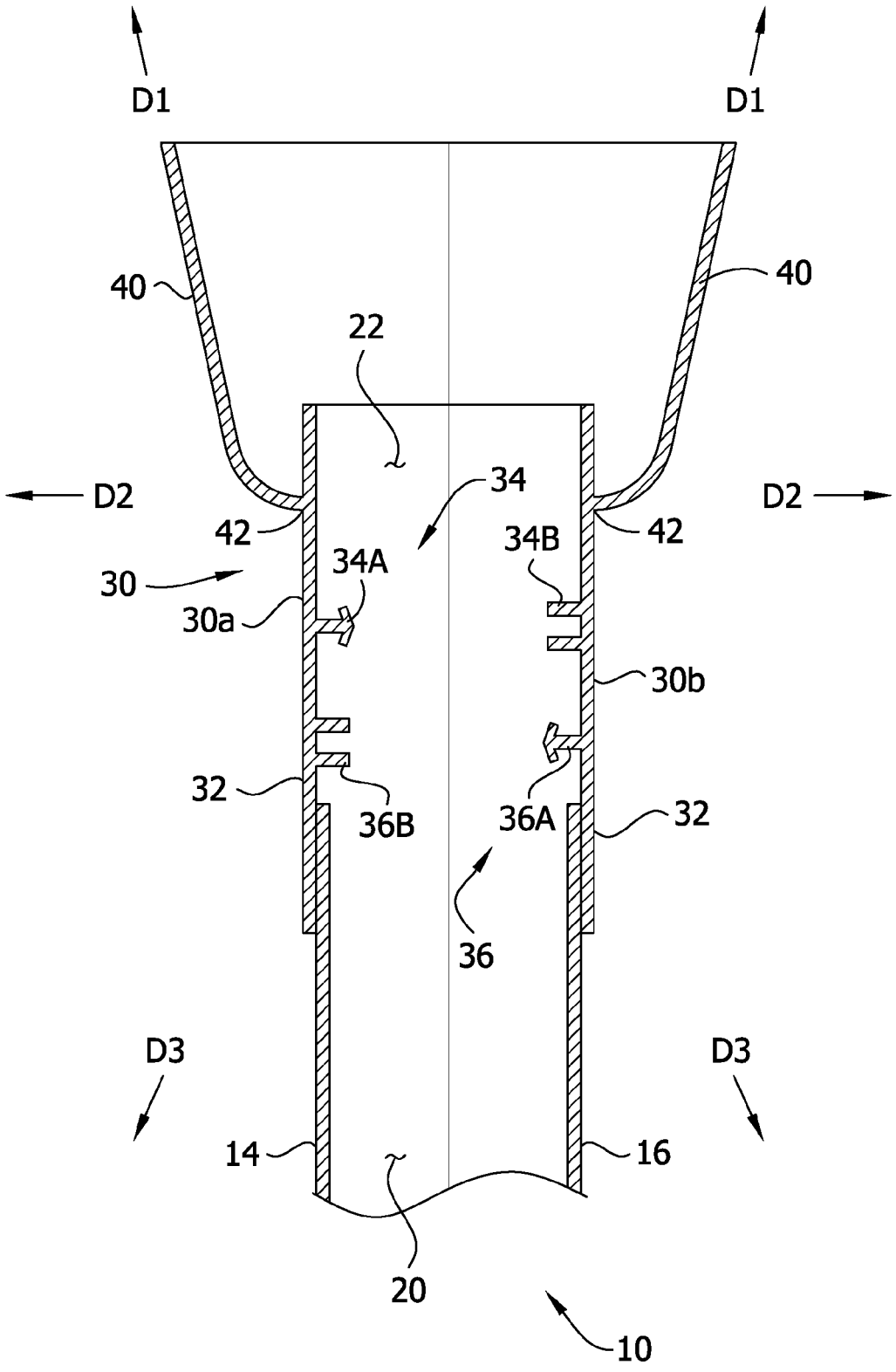
FIG. 6 is an enlarged fragmentary section of the plane 6-6 of FIG. 2.

A closure member, generally indicated at reference number 30, is appended to the top margin of each bag panel 14, 15 for selectively opening and closing the bag 10. The closure member 30 includes opposing elements 30*a*, 30*b* that each extend across the width of the bag body 12 and are joined together at their side margins. In a preferred embodiment, each closure member element 30*a*, 30*b* is a one-piece body of polymeric material formed, for example, in a profile extrusion process. However, in certain embodiments, parts of the each closure member element 30 can be formed of different materials and according to different production methods without departing from the scope of the invention. In one embodiment, the closure member 30 can be opaque. Preferably the closure member elements 30*a*, 30*b* are appended to the bag panels 14, 16 after the bag body 12 and closure member elements 30*a*, 30*b* are formed. However, it is contemplated that the closure members and bag body 12 could be formed together as one piece in, for example, a coextrusion process without departing from the scope of the invention. As illustrated in FIG. 6, each closure member element 30*a*, 30*b* includes a wall 32 that is attached (e.g., adhered, fused, etc.) to the outside surface of a respective one of the bag panels 14, 16 to secure the closure member to the bag body 12. It will be understood that the walls 32 may be attached to the inside surface of the bag panels. More specifically, a bottom margin of the wall 32 overlies a top margin of the bag panel 14, 16.

Together, the two closure member elements 30*a*, 30*b* define two distinct interlocking formations 34, 36, which function as a reclosable closing structure for repeatedly and non-destructively closing the bag opening 22. Each interlocking formation 34, 36 extends between opposite sides of the bag 10 and is located between the top and bottom edges of the wall 32. In the illustrated embodiment, the interlocking formations 34, 36 each include a respective male zipper profile 34A, 36A and female zipper profile 34B, 36B extending inwardly from the respective wall 32. The male zipper profiles 34A, 36A are configured and arranged to be selectively mated to the female zipper profiles 34B, 36B to close and seal the bag opening 22. Though the particular arrangement of male and female zipper profiles can be changed without departing from the scope of the invention, in the embodiment illustrated in FIG. 6, a left closure member element 30*a* includes an upper male profile 34A and a lower female profile 36B and the right closure member element 30*b* includes an upper female profile 34B and a lower male profile 36A. It will be understood that other reclosable closing structures besides the interlocking formations 34, 36 can also be used without departing from the scope of the invention. For example, it is contemplated that other numbers of zipper profiles can be used without departing from the scope of the invention. In a preferred embodiment, the interlocking formations 34, 36 are configured to close the bag 10 to form a fluid tight, liquid tight, and/or gas tight seal. In other embodiments, the interlocking formations 34, 36 can be closed without forming a seal.

Each closure member element 30*a*, 30*b* comprises a gripping panel 40 that extends laterally outward and upward from the respective wall 32. The gripping panel 40 is pivotably connected to the wall 32 at a flexible joint 42 positioned between the top and bottom ends of the wall. The flexible joint 42 forms a living hinge between the wall 32 and the gripping panel 40 that permits the gripping panel 40 to pivot about the flexible joint. A lower portion (broadly, an inner portion) of the gripping panel 40 adjacent the flexible joint 42 extends in a generally laterally outward direction from the wall 32 and the first and second panels 14, 16. An upper portion (broadly, an outer portion) of the gripping panel 40 extends in a generally upward direction away from the bag opening 22. At least part of the upper portion of each gripping panel 40 is in laterally opposed relation with a portion of the wall 32 from which the gripping panel extends in the illustrated embodiments. Because the gripping panels 40 extend laterally outward from the walls 32, the upper portions are laterally spaced apart from one another between the opposite sides. Preferably, the hinge panels 40 are constructed so as to be resiliently biased toward the illustrated position in which the upper portion thereof extends in an upward direction away from the bag opening 22. In addition, the gripping panels 40 are joined along their side margins, which support the upper portions in the illustrated upwardly oriented position. Alternatively, the gripping panels 40 could be separate along their side margins or frangibly or otherwise releasably joined as discussed in further detail below.

The lateral spacing of the upper portions of the gripping panels 40 enables a user to easily place a finger between the closure member elements 30*a*, 30*b*. Thus, a user can grip the gripping panels 40 separately to pull the closure member elements 30*a*, 30*b* apart from one another and selectively open the bag 10. The gripping panels 40 are configured to pivot about the flexible joint 42 so that the user can easily adjust the angle at which separation forces are applied to the closure member elements 30*a*, 30*b*. For example, as shown in FIG. 6, the gripping panels 40 can be selectively pivoted to an upwardly oriented position at which tension applied to the gripping panels applies a separation force on the closure member elements 30*a*, 30*b* in an upwardly and outwardly oriented direction D1. Likewise, the gripping panels 40 can be selectively pivoted to an outwardly oriented position at which tension applied to the gripping panels applies a separation force on the closure member elements 30*a*, 30*b* in a substantially outwardly oriented direction D2. In addition, the gripping panels 40 can be selectively pivoted to a downwardly oriented position (not shown) at which tension applied to the gripping panels applies a separation force on the closure member elements 30*a*, 30*b* in a downwardly and outwardly oriented direction D3. The gripping panels 40 can also be selectively pivoted to other positions between the original position illustrated in FIG. 6 and the downwardly oriented position. Preferably, the walls 32 remain oriented substantially vertically as shown in FIG. 6 as the gripping panels 40 pivot between the upwardly oriented position and the downwardly oriented position.

It is contemplated that the interlocking formations 34, 36 could be child-resistant, inhibiting opening of the bag 10 when separation forces are applied to the closure member elements 30*a*, 30*b* or bag panels 14, 16 in any direction other than an unlocking direction. The gripping panels 40 are preferably selectively pivotable to an angular position at which tension applied to the gripping panels applies a separation force on the closure member elements 30*a*, 30*b* in the unlocking direction. It is also contemplated that the first interlocking formation 34 could inhibit opening of the bag 10 unless separation forces are applied in a first unlocking direction and the second interlocking formation 36 could inhibit opening of the bag unless separation forces are applied in a second unlocking direction. To open this embodiment of the bag 10, the gripping panels 40 are first pivoted to a first position in which the gripping panels are angularly aligned with the first unlocking direction. Applying a tension on the gripping panels 14 in the first position disengages the first interlocking formation 34. Subsequently, the gripping panels 40 are pivoted to a second position in which the gripping panels are angularly aligned with the second unlocking direction. Applying a tension on the gripping panels 40 in the second position disengages the second interlocking formation 36 to open the bag.

It is also contemplated that the closure member 30 could be tamper-resistant, providing evidence of attempts to open the bag 10. For example, in one or more embodiments, the gripping panels 40 are weakly joined along their side margins. For example, the gripping panels 40 can panels can be bonded to one another discontinuously along their side margins. Alternatively a zone of weakness (e.g., perforations) could be provided along the side margins of the gripping panels 40 adjacent to where they are attached to one another. When the gripping panels 40 are pulled apart in an attempt to open the bag, they become separated along their side margins, providing evidence of the attempted bag opening. It is particularly contemplated that this tamper resistant feature could be combined with child-resistant interlocking formations 34, 36 that inhibit opening of the bag 10 unless forces are applied to the gripping panels in an unlocking direction. In such an embodiment, pulling the gripping panels 40 in a position to disengage the child-resistant interlocking formations 34, 36 would also cause the gripping panels to become separated along their side margins, providing evidence of attempts to open the bag.

With further reference to FIG. 6, in one or more embodiments, the flexible joints 42 are spaced apart above the upper and lower interlocking formations 34, 36. When a tension is applied against the gripping panels 40, the top end margins of the walls 32 bend outwardly away from one another above the upper and lower interlocking formations 34, 36. As a result, a downwardly and outwardly oriented bending torque is concentrated on the upper zipper profile members 34A, 34B until they disengage. Such a bending torque is operable to cause the female zipper profile 34B to pivot about the male zipper profile 34A such that the portions of the walls 32 immediately above the interlocking formation 34 tend to separate and the portions of the walls immediately below the interlocking formation tend to come together. After the zipper profiles 34A, 34B become disengaged, a downwardly oriented bending torque is concentrated on the lower zipper profile members 36A, 36B. It is believed that a substantial torque can be generated in this configuration, which is effective to disengage the interlocking formations 34, 36, even when they configured for robust interlocking engagement.

Figure 7:
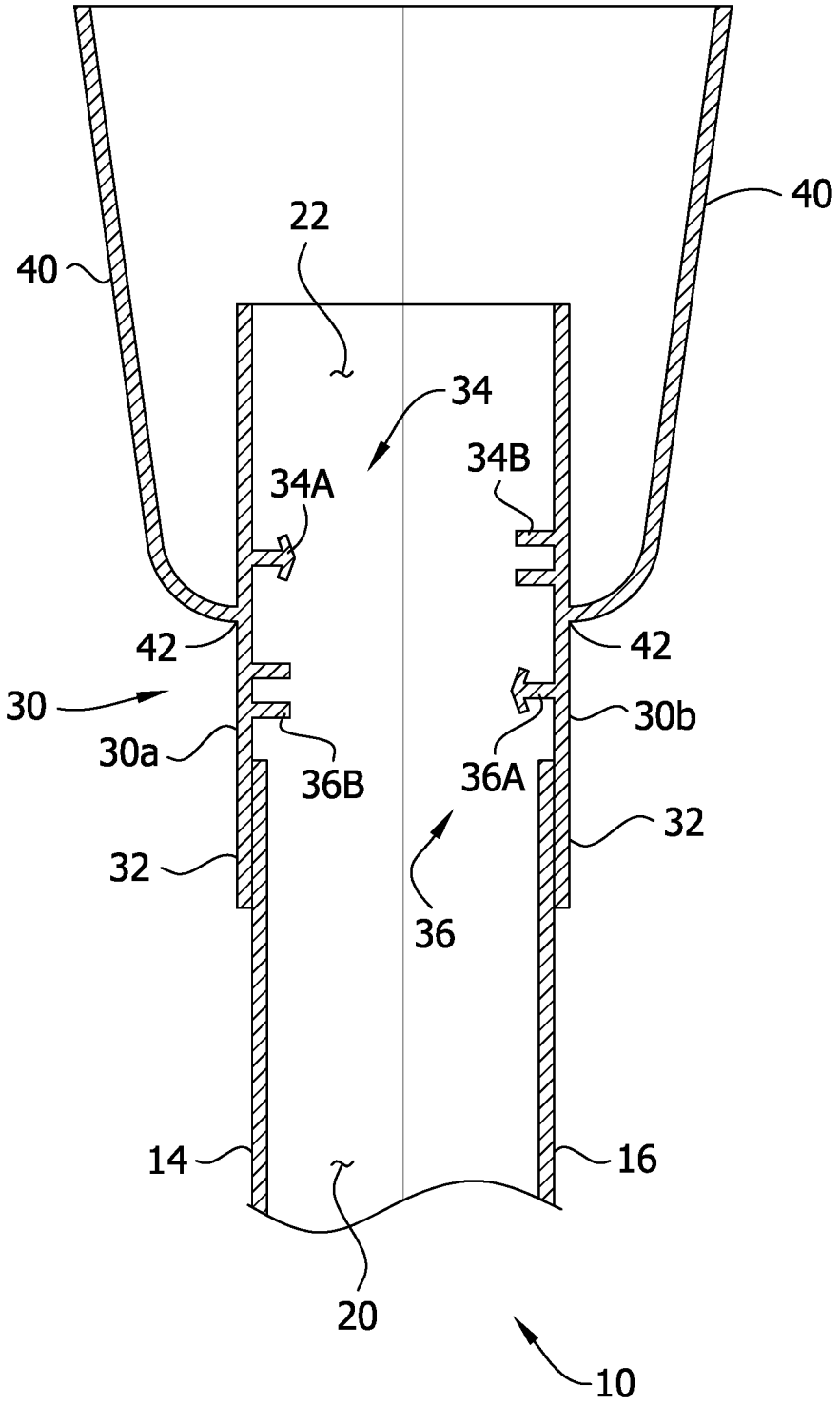
FIG. 7 is a section of another embodiment of a bag.

As shown in FIG. 7, in other embodiments, the flexible joints 42 are positioned between the upper and lower interlocking formations 34, 36 (i.e., the gripping panels 40 extend outwardly from the wall 32 between the upper and lower interlocking formations). When a tension is applied against the gripping panels 40, portions of the walls 32 between the interlocking formations 34, 36 tend to separate from one another. As compared with the embodiment of FIG. 6, it is believed that the separation force applied on the interlocking formations 34, 36 in FIG. 7 will be more directly outward to the sides as compared to the peeling action achieved with the embodiment of FIG. 6. Moreover, the force is applied simultaneously to both of the interlocking formations.

Figure 8:
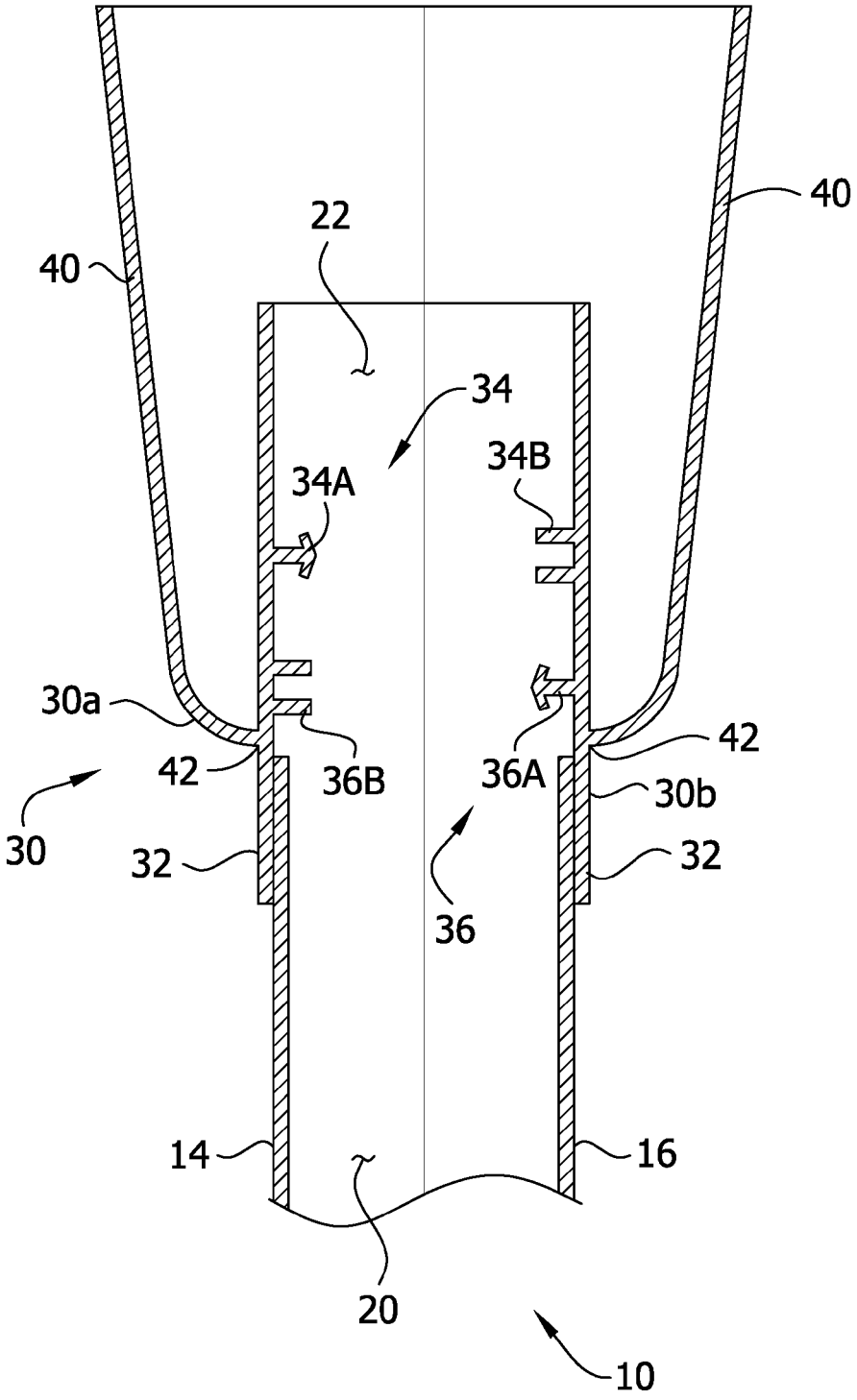
FIG. 8 is a section of another embodiment of a bag.

As shown in FIG. 8, in yet another embodiment, the flexible joints 42 are positioned beneath the upper and lower interlocking formations 34, 36. When a tension is applied against the gripping panels 40, the bottom end margins of the walls 32 bend outwardly away from one another beneath the first and second interlocking formations. As a result, an upwardly and outwardly oriented bending torque is concentrated on the lower zipper profile members 36A, 36B. The bending torque is operable to cause the female zipper profile 36B to pivot about the male zipper profile 36A such that the portions of the walls 32 immediately above the lower interlocking formation 36 tend to come together and the portions of the walls immediately below the lower interlocking formation tend to separate from one another. As described in U.S. Pat. No. 3,425,469 and U.S. Application Publication No. 2013/0195385, certain child-resistant zipper profiles are designed to inhibit opening unless the zippers pivot in this way. Accordingly, in one or more embodiments, a pair of closure member elements 30*a*, 30*b* includes one or more child-resistant interlocking formations 34, 36 configured to inhibit opening unless the closure members are pulled apart from one another beneath the mated interlocking formations. In these embodiments, the closure members preferably include a gripping panel 40, which extends outwardly from the wall 32 from a position beneath the interlocking formations 34, 36.

Figure 9:
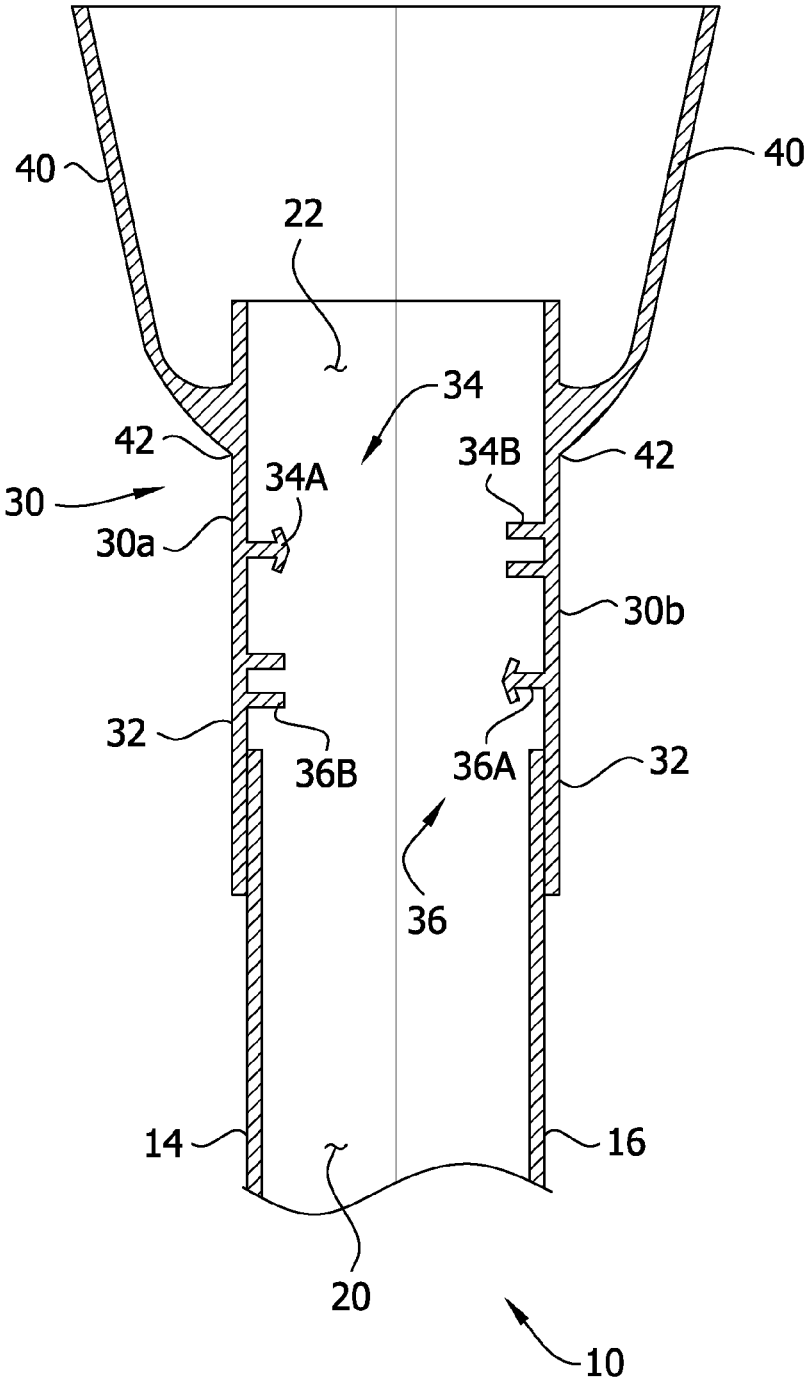
FIG. 9 is a section of another embodiment of a bag.

Referring to FIG. 9, in certain embodiments, additional material is added to the bag 10 at the flexible joints 42. In the illustrated embodiment, the flexible joint 42 is thicker than the gripping panel 40 and the wall 32 of the closure member 30 (e.g., up to about five-times the thickness of the gripping pane 40 and the wall 32 or more preferably from about 1.2-times to about 3-times the thickness of the gripping panel and the wall). The increased thickness of the flexible joint 42 improves the robustness of the joint to prevent tearing along the joint when the gripping panels 40 are manipulated and pulled to open the bag 10. For example, should the panels 40 be pulled in a direction other than the intended opening direction, tearing of the panels from the wall 32 is resisted by the increased thickness of the joints 42.

In view of the foregoing, one skilled in the art will appreciate that the bag 10 has several advantages. For example, because the gripping panels 40 are laterally spaced apart from one another, a user can easily grip the gripping panels to open the bag 10. The flexible joints 42 enable separation forces to be applied against the closure member elements 30*a*, 30*b* in a range of directions. In addition, the gripping panels 40 and flexible joints 42 can be positioned relative one or more interlocking formations 34, 36 to apply different types of opening forces, which may be preferred for different types of interlocking formations.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above apparatuses, systems, and methods without departing from the scope of the invention, it is intended that all matter contained in the above description and shown in the accompanying drawings shall be interpreted as illustrative and not in a limiting sense.

What is claimed is:

1. A bag having top and bottom edge margins and opposite side margins, the bag comprising:

first and second bag panels defining a bag interior and an opening at the top edge margin of the bag;

a reclosable closing structure at the top edge margin of the bag configured to repeatedly close the bag; and first and second gripping panels joined to the top edge margin of the bag at first and second joints, respectively, the first joint connecting the first gripping panel to the first bag panel and the second joint connecting the second gripping panel to the second bag panel, the first and second gripping panels extending from the first and second joints, respectively, outwardly away from one another to respective free ends to define surfaces for gripping and pulling the first and second gripping panels apart to open the bag;

wherein each of the first and second gripping panels includes an inner portion adjacent the respective flexible joint and an outer portion adjacent the respective free end; and wherein the inner portion of each gripping panel is resiliently biased to extend generally laterally outward from the flexible joint and the outer portion is resiliently biased to extend generally upward from the inner portion such that the gripping panels are resiliently biased to define a gap between the outer portions and the free ends thereof.

2. A bag as set forth in claim 1 wherein the outer portions of the first and second gripping panels are spaced apart from one another to receive a finger therebetween.

3. A bag as set forth in claim 1 wherein at least outermost segments of the outer portions of the first and second gripping panels are located above the top edge margin of the bag.

4. A bag as set forth in claim 1 wherein the outer portions of the first and second gripping panels have respective thicknesses and the first and second joints have respective thicknesses, the thicknesses of the first and second joints being thicker than the thicknesses of the outer portions of the gripping panels.

5. A bag as set forth in claim 1 wherein a segment of at least one of the first and second gripping panels is positioned in spaced apart, laterally opposed relation with another surface defined by the top edge margin of the bag.

6. A bag as set forth in claim 1 wherein each of the first and second joints is a flexible joint.

7. A bag as set forth in claim 6 wherein each of the first and second gripping panels is selectively pivotable about the respective one of the first and second joints.

8. A bag as set forth in claim 7 wherein the first and second gripping panels are pivotable at least from a generally upward extending position to a generally downwardly extending position.

9. A bag as set forth in claim 7 wherein at least one of the first and second gripping panels is pivotable to an unlocked position, the reclosable closing structure being configured to permit the bag to be opened when the first and second gripping panels are pulled apart with said at least one of the gripping panels in the unlocked position and to inhibit the bag from being opened when the first and second gripping panels are pulled apart with said at least one of the gripping panels in a position other than the unlocked position.

10. A bag as set forth in claim 1 wherein the reclosable closing structure comprises at least one interlocking formation.

11. A bag as set forth in claim 10 wherein said at least one interlocking formation is spaced apart from the first and second joints toward the bottom edge margin of the bag.

12. A bag as set forth in claim 10 wherein the first and second joints are spaced apart from said at least one interlocking formation toward the bottom edge margin of the bag.

13. A bag as set forth in claim 10 wherein said at least one interlocking formation comprises a first interlocking formation and a second interlocking formation spaced apart from the first interlocking formation toward the bottom edge margin of the bag, the first and second joints being located at a position between the first and second interlocking formations.

14. A bag as set forth in claim 1 wherein the first and second gripping panels are frangibly joined together at the side margins of the bag such that the first and second gripping panels are configured to separate from one another at the side edge margins of the bag when the first and second gripping panels are pulled apart.

15. A bag having top and bottom edge margins and opposite side margins, the bag comprising:

first and second bag panels defining a bag interior and an opening at the top edge margin of the bag;

a reclosable closing structure at the top edge margin of the bag configured to repeatedly close the bag; and first and second gripping panels joined to the top edge margin of the bag at first and second flexible joints, respectively, the first joint connecting the first gripping panel to the first bag panel and being configured to allow the first gripping panel to be pivoted about the first joint with respect to the first bag panel, the second joint connecting the second gripping panel to the second bag panel and being configured to allow the second gripping panel to be pivoted about the second joint with respect to the second bag panel;

wherein each of the first and second gripping panels includes a free end, an inner portion adjacent the respective flexible joint, and an outer portion adjacent the free end; and wherein the inner portion of each gripping panel is resiliently biased to extend generally laterally outward from the flexible joint and the outer portion is resiliently biased to extend generally upward from the inner portion such that the gripping panels are resiliently biased to define a gap between the outer portions and the free ends thereof.

16. A reclosable closure for repeatably closing a bag, the closure comprising first and second closure elements, each of the first and second closure elements including vertically oriented walls, an interlocking profile, and a gripping panel, each interlocking profile extending inward from the respective wall in opposing relationship with the other interlocking profile and the interlocking profiles being configured for interlocking engagement when the bag is closed, each gripping panel being joined to the respective wall at a joint and extending outward from the respective joint to a free end spaced apart from the respective wall;

wherein each of the gripping panels includes an inner portion adjacent the joint and an outer portion adjacent the free end; and wherein the inner portion of each gripping panel is resiliently biased to extend generally laterally outward from the joint and the outer portion is resiliently biased to extend generally upward from the inner portion such that the gripping panels are resiliently biased to define a gap between the outer portions and the free ends thereof.

17. A reclosable closure as set forth in claim 16 wherein each of the joints is a flexible joint, each gripping panel being selectively pivotable about the respective joint.

18. A bag as set forth in claim 1 wherein each of the first and second gripping panels is resiliently biased to curve between the inner portion and the outer portion.

19. A reclosable closure as set forth in claim 16 wherein each of the gripping panels is resiliently biased to curve between the inner portion and the outer portion.

20. A reclosable closure as set forth in claim 16 wherein each of the gripping panels is integrally formed with the respective vertical wall.

* * * * *